US008111127B1

(12) United States Patent
Chan et al.

(10) Patent No.: US 8,111,127 B1
(45) Date of Patent: Feb. 7, 2012

(54) THERMISTOR

(75) Inventors: Chun-Kong Chan, Taipei County (TW); Chi-Ching Chen, Taipei County (TW)

(73) Assignee: Lien Chang Electronic Enterprise Co., Ltd., Taipei County (TW)

( * ) Notice: Subject to any disclaimer, the term of this patent is extended or adjusted under 35 U.S.C. 154(b) by 27 days.

(21) Appl. No.: 12/837,698

(22) Filed: Jul. 16, 2010

(51) Int. Cl.
*H01C 7/10* (2006.01)

(52) U.S. Cl. ..... 338/22 R; 439/83

(58) Field of Classification Search ..... 338/22 R
See application file for complete search history.

(56) References Cited

U.S. PATENT DOCUMENTS 4,293,768 A * 10/1981 Adachi et al. ..... 250/338.3
4,302,674 A * 11/1981 Adachi et al. ..... 250/338.3
4,699,445 A * 10/1987 Porta et al. ..... 439/698
5,929,743 A * 7/1999 Miyazaki et al. ..... 338/22 R
6,020,809 A * 2/2000 Miyazaki et al. ..... 338/22 R
7,942,678 B2 * 5/2011 Sanford et al. ..... 439/83
2006/0014404 A1 * 1/2006 Iwamoto et al. ..... 439/76.2

* cited by examiner

*Primary Examiner* — James Harvey
(74) *Attorney, Agent, or Firm* — Rosenberg, Klein & Lee

(57) ABSTRACT

A thermistor comprises a main body, two electric plugs, a metallic fixing piece, and a cover. The electric plugs are located on one end of the main body, and the metallic fixing piece is located on the side of the main body. The metallic fixing piece has a connecting portion up against one side of the main body, and a soldering portion located on the other end of the main body, opposite to the electric plugs and protruding from the main body. The cover is over the main body and the connecting portion of the metallic fixing piece, thereby securing the metallic fixing piece to the main body. The soldering portion of the metallic fixing piece can be soldered directly onto the printed circuit board, thereby anchoring the thermistor to the printed circuit board more securely.

6 Claims, 4 Drawing Sheets

THERMISTOR

BACKGROUND OF THE INVENTION

1. Field of the Invention

The present invention relates to a thermistor; in particular, to a thermistor capable of being fixed to a printed circuit board firmly.

2. Description of the Related Art

Based on temperature change, the resistance of a thermistor changes accordingly. With high sensitivity, accuracy and stability, the thermistor is widely used as a sensor in measuring, compensating, and controls. Industrial applications include consumer electronic products, automobiles, medical instruments, food processing, communication and instrumentation, military equipments, aerospace, and research & development areas.

When mounting the thermistor onto the printed circuit board, the conventional procedure involves connecting both electric plugs of the thermistor into the pre-cut slots on the circuit board. Next, the assembly is transferred to a tin soldering furnace, where the electric plugs are soldered onto the printed circuit board. To prevent damaging the thermistor due to external forces or falling off from the printed circuit board, glue is added manually between the thermistor and the printed circuit board. Several disadvantages are associated with the above practice. First, not all thermistor may be glued properly. Second, the glue may peel off. Thirdly, manual effort and time are wasted in the process.

To solve the above problems, the inventor proposed a new thermistor based on past research and expertise.

SUMMARY OF THE INVENTION

The object of the present invention is to provide a thermistor that connects to a metallic fixing piece. The fixing piece is designated for soldering onto the printed circuit board, thereby anchoring the thermistor to the printed circuit board more securely.

To achieve the aforementioned object, the present invention provides a thermistor including: a main body; two electric plugs located on one end of the main body; a metallic fixing piece placed on the side of the main body. The metallic fixing piece has a connecting portion with one side of the main body, and a soldering portion at the other end of the main body. The soldering location is opposite to the electric plugs and protrudes from the main body. The other component is a cover, which is over the main body and the fixing piece's connecting location. Providing a snug fit, the cover ensures the metallic fixing piece is firmly attached to the main body.

The cover is temperature dependent and acts as a heat shrink sleeve.

The present invention has several advantages. First, the metallic fixing piece can be soldered onto the printed circuit board, thus allowing the thermistor to be attached more firmly. If under vibrations due to external forces, the thermistor is less likely to suffer damages or falls off the printed circuit board. Second, the thermistor's electric plugs and the soldering portion of the metallic fixing piece can be soldered onto the printed circuit board with only one soldering process. Thus, manual glue dispensing is not needed, thereby eliminating the material cost of the glue, simplifying the manufacturing process and shortening the production time. Consequently, the overall manufacturing cost is reduced.

For reference, detailed explanation and illustrations are included below for the present invention.

DETAILED DESCRIPTION OF THE PREFERRED EMBODIMENTS

The aforementioned illustrations and following detailed descriptions are exemplary for the purpose of further explaining the scope of the present invention. Other objectives and advantages related to the present invention will be illustrated in the subsequent descriptions and appended drawings.

Figure 1:
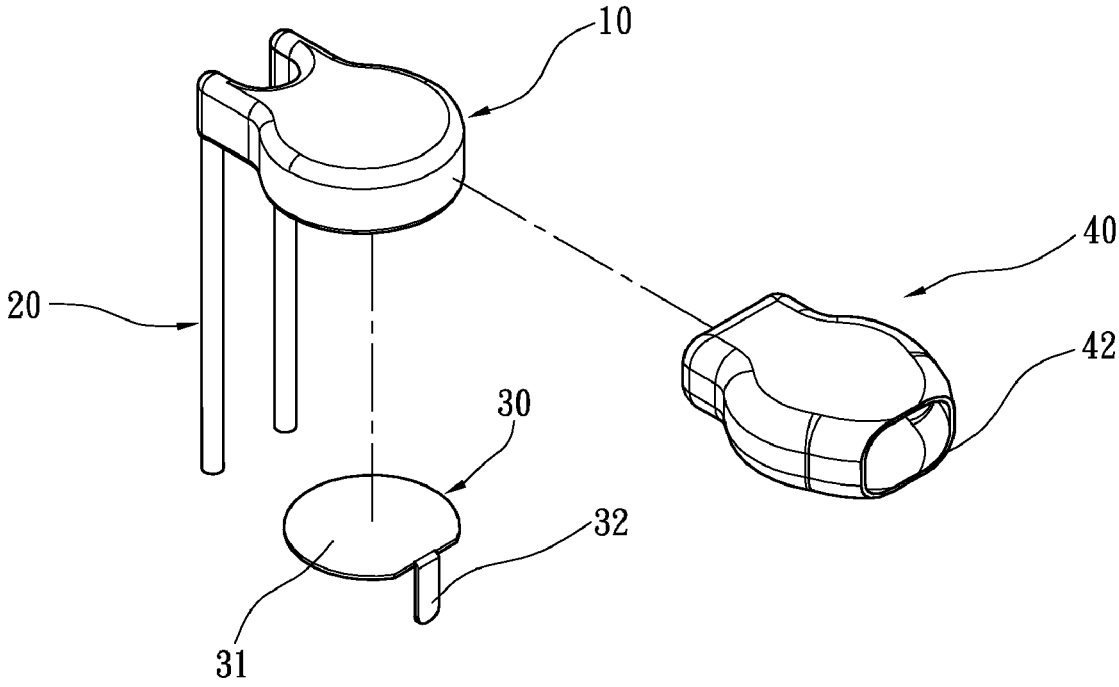
FIG. 1 shows an exploded view of the thermistor.
Figure 2:
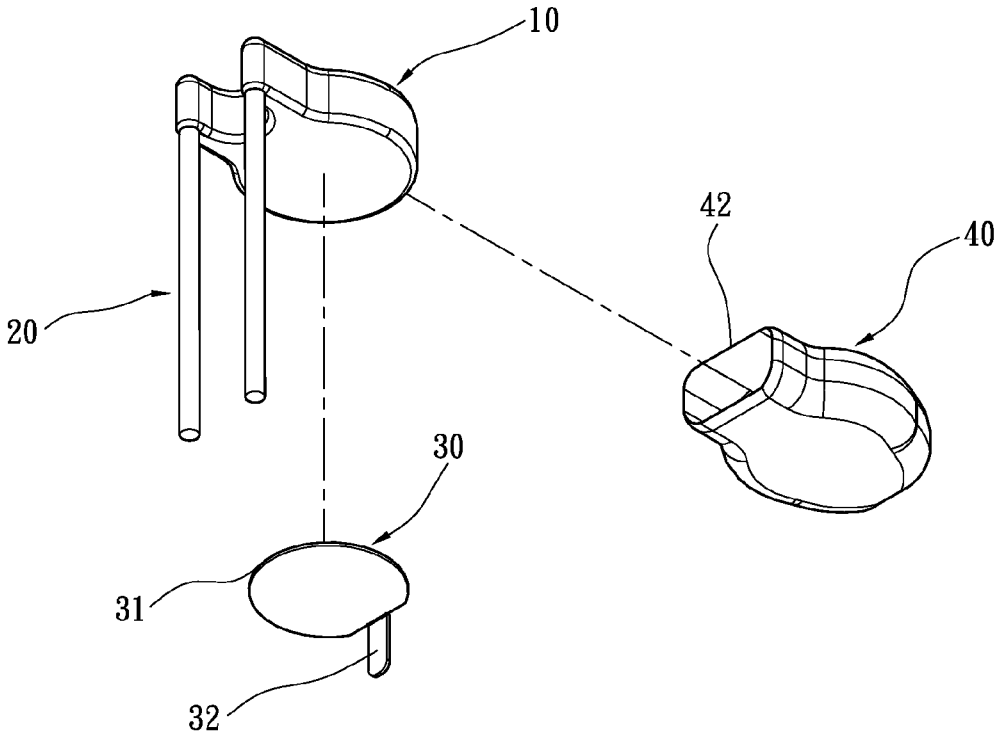
FIG. 2 shows an exploded view of the thermistor from another angle.
Figure 3:
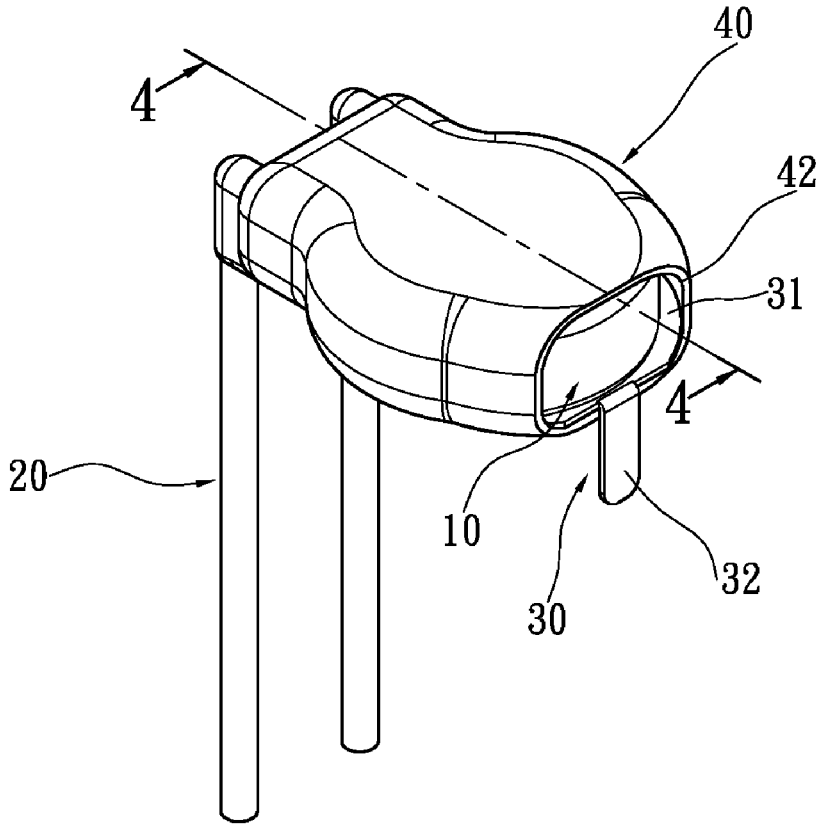
FIG. 3 shows an assembled view of the thermistor.
Figure 4:
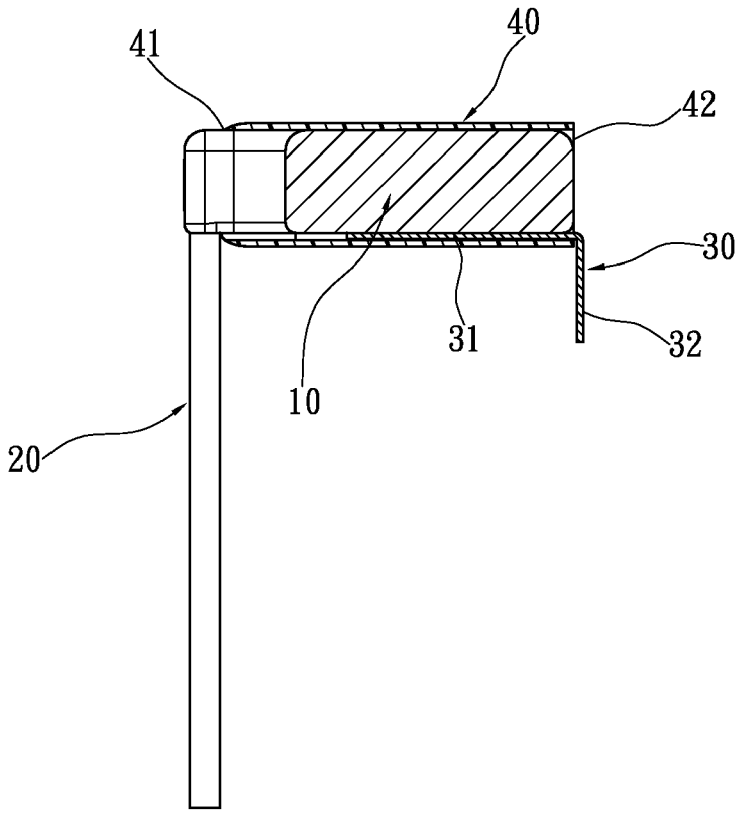
FIG. 4 is a cross-sectional view of line 4-4 in FIG. 3.

Please refer to FIG. 1~3. The present invention provides a thermistor including a main body 10, two electric plugs 20, a metallic fixing piece 30, and a cover 40.

The two electric plugs 20 are located on one end of the main body 10 and electrically connected to the main body 10. The two electric plugs 20 have different polarities from each other, with equal or different lengths. The electric plugs 20 are connected mechanically and electrically to the slots in the printed circuit board (not shown in picture).

The metallic fixing piece 30 is located on one side of the main body 10, with a connecting portion 31 and a soldering portion 32. The shape of the connecting portion 31 substantially corresponds to that of the main body 10, with the connecting portion 31 laying against one side of the main body 10. The soldering portion 32 is narrower than the connecting portion 31, but it is not limited thereto. The soldering portion 32 is located on the other end of the main body 10, opposite to the electric plugs 20 and protrudes from the main body 10. In other words, the soldering portion 32 and the electric plugs 20 are located on two opposite ends of the main body 10. Furthermore, the material selection for the metallic fixing piece 30 is open for selection. The suggested choice is tin plate.

The cover 40 is over the main body 10 and the connecting portion 31 of the metallic fixing piece 30, thereby holding the metallic fixing piece 30 securely to one side of the main body 10. With such arrangement, the thermistor of the present invention is assembled accordingly.

More specifically, in the present embodiment, the metallic fixing piece 30 is located on the bottom surface of the main body 10. The upper surface of the connecting portion 31 lays against the bottom surface of the main boy 10 for supporting the main body 10 upwards. The soldering portion 32 is formed by bending and extending downwards from one end of the connecting portion 31 away from the electric plugs 20.

Furthermore, in the present embodiment, the cover 40 is a heat shrink sleeve. When mounting the metallic fixing piece 30, the heat shrink sleeve of desired length surrounds the main body 10 and the connecting portion 31 of the metallic fixing piece 30. Next, by blowing hot air, the heat shrink sleeve shrinks and snugs the main body 10 with the connecting portion 31 of the metallic fixing piece 30.

When mounting the thermistor, the electric plugs 20 and the soldering portion 32 of the metallic fixing piece 30 are connected mechanically to predetermined slots on the printed circuit board. Next, the printed circuit board and the thermistor are transferred into a soldering furnace. The electric plugs 20 and the soldering portion 32 of the metallic fixing piece 30 are then soldered onto the printed circuit board, thereby firmly securing the thermistor.

Per FIG. 1~4, the cover 40 has a first opening 41 for the electric plugs 20, along with a second opening 42 at the soldering portion 32 of the metallic fixing piece 30. Such arrangement allows the electric plugs 20 and the soldering portion 32 of the metallic fixing piece 30 be exposed to the outside of the cover 40.

In summary, the thermistor of the present invention has two electric plugs located on one end of the main body and soldered to the printed circuit board. A cover is used to hold the metallic fixing piece to one side of the main body. The soldering portion of the metallic fixing piece is located on the other end of the main body, opposite to the electric plugs. The soldering portion of the metallic fixing piece is soldered onto the printed circuit board, thereby connecting the thermistor to the printed circuit board more firmly than before. Even when the thermistor is subjected to vibration or swing due to external forces, the thermistor is not likely to be damaged or falls off from the printed circuit board Inside the furnace, both the thermistor's electric plugs and the soldering portion of the metallic fixing piece can be soldered to the printed circuit board in mere one soldering process. As a result, manual glue dispensing is no longer needed, thereby eliminating the glue cost, simplifying the manufacturing process, shortening the production time, and reducing the overall manufacturing cost.

The descriptions illustrated supra set forth simply the preferred embodiments of the present invention; however, the characteristics of the present invention are by no means restricted thereto. All changes, alternations, or modifications conveniently considered by those skilled in the art are deemed to be encompassed within the scope of the present invention delineated by the following claims.

What is claimed is:

1. A thermistor, comprising:

a main body;

two electric plugs located on one end of the main body;

a metallic fixing piece situated on one side of the main body, with the metallic fixing piece having a connecting portion laying against one side of the main body, and a soldering portion provided on the other end of the main body, opposite to the electric plugs and protruding from the main body; and a cover holding the main body and the connecting portion of the metallic fixing piece, thereby securing the metallic fixing piece to the main body.

2. The thermistor according to claim 1, wherein the soldering portion of the metallic fixing piece is formed by bending and extending from one end of the connecting portion away from the electric plugs.

3. The thermistor according to claim 2, wherein the metallic fixing piece is provided on the bottom surface of the main body, with the upper surface of the connecting portion up against the lower surface of the main body, and the soldering portion is formed by bending downwards and extending from one end of the connecting portion away from the electric plugs.

4. The thermistor according to claim 3, wherein the cover is provided with a first opening at the location of electric plugs, with a second opening at the soldering portion of the metallic fixing piece.

5. The thermistor according to claim 1, wherein the cover is a heat shrink sleeve.

6. The thermistor according to claim 1, wherein the metallic fixing piece is made of tin plate.

* * * * *